United States Patent [19]

Arnold

[11] Patent Number: 5,000,384

[45] Date of Patent: Mar. 19, 1991

[54] WATER MISTING APPARATUS FOR A CHAIR

[76] Inventor: Timothy S. Arnold, 3981 Frandon Ct., Simi Valley, Calif. 93063

[21] Appl. No.: 470,802

[22] Filed: Jan. 26, 1990

[51] Int. Cl.[5] ..... A47C 7/72; B05B 15/08; B05B 1/24

[52] U.S. Cl. ..... 239/128; 239/135; 239/289; 239/587; 165/48.2; 297/180; 297/184

[58] Field of Search ..... 239/128, 135, 289, 587; 165/48.2; 297/180, 184

[56] References Cited

U.S. PATENT DOCUMENTS

| | | | |
|---|---|---|---|
| 2,727,366 | 12/1955 | Hagen | 239/289 X |
| 3,625,434 | 12/1971 | Kitover | 297/180 X |
| 4,250,712 | 2/1981 | Meloni | 165/48.2 X |
| 4,338,991 | 7/1982 | Sigworth, Jr. | 165/48.2 X |
| 4,519,544 | 5/1985 | Szabo | 239/587 X |
| 4,765,542 | 8/1988 | Carlson | 239/289 |
| 4,846,525 | 7/1989 | Manning | 239/289 X |
| 4,854,502 | 8/1989 | Cox | 239/289 X |
| 4,871,141 | 10/1989 | Chen | 297/184 X |
| 4,925,099 | 5/1990 | Owen | 239/289 |

FOREIGN PATENT DOCUMENTS

| | | | |
|---|---|---|---|
| 2066440 | 7/1981 | United Kingdom | 165/48.2 |

*Primary Examiner*—Andres Kashnikow
*Assistant Examiner*—William Grant
*Attorney, Agent, or Firm*—Jack C. Munro

[57] ABSTRACT

A water misting apparatus to be attached to a chair such as a lounge chair that is designed to be utilized in an outdoors environment. The water misting apparatus includes several spray nozzles attached to the chair with each spray nozzle to be individually adjustable to vary the direction of flow from the nozzles. The flow from the nozzles is to be directed so that a mist is sprayed onto an occupant of the chair. The nozzles are supplied water from a series of conduits which are in turn connected to a pressurized supply tank. The conduit assembly includes a heat exchanger which can be utilized to either increase or decrease the temperature of the water. A separate umbrella, which includes water misting dispensing nozzles, can be attached to the chair.

6 Claims, 1 Drawing Sheet

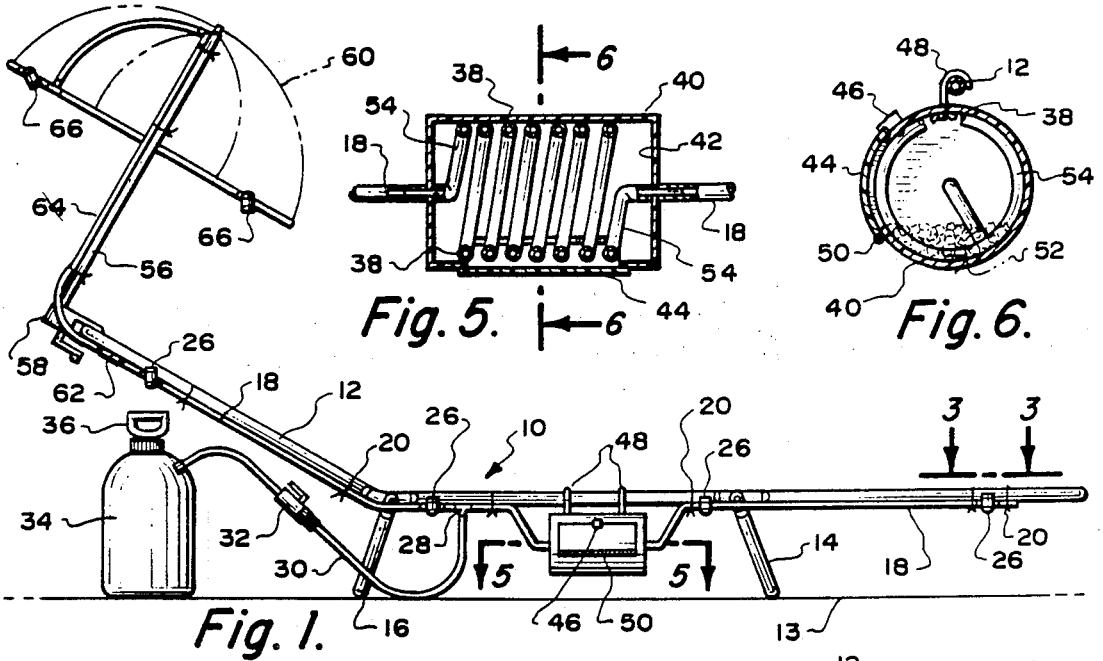
Fig. 1.
Fig. 5.
Fig. 6.
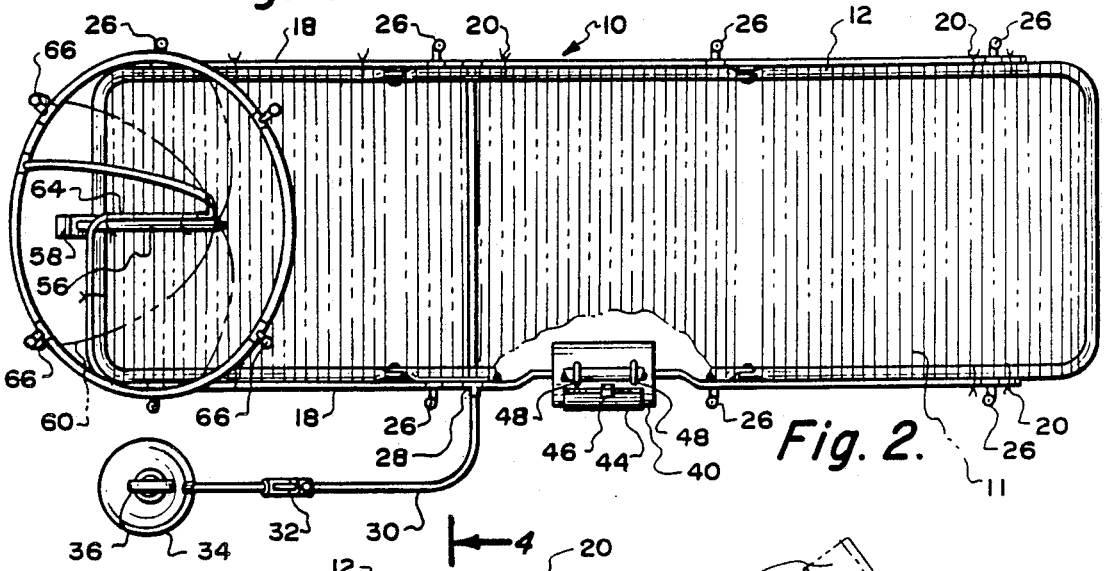
Fig. 2.
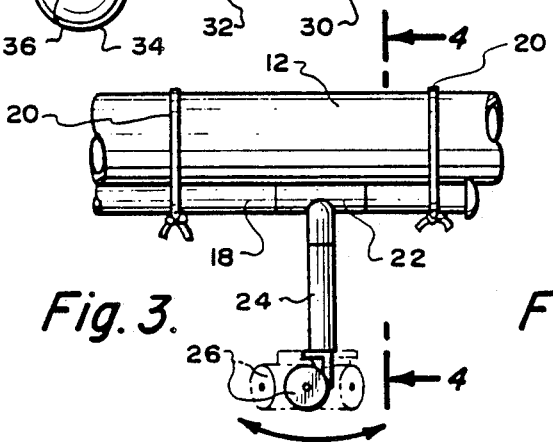
Fig. 3.
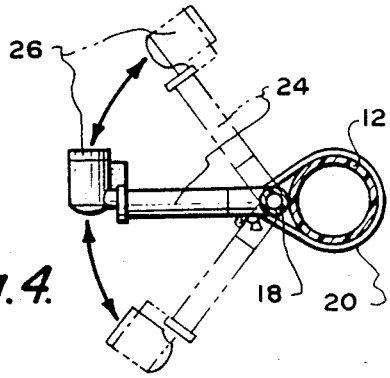
Fig. 4.

WATER MISTING APPARATUS FOR A CHAIR

BACKGROUND OF THE INVENTION

The field of this invention relates to a water misting apparatus which is attached to a a chair, such as a lounge chair, for the purpose of applying a cooling water spray to an occupant of the chair that is sunbathing.

Sunbathing for the purpose of obtaining a suntan is a desirable form of activity by a great number of human beings. One of the reasons for sunbathing is to obtain a suntan. A suntan by a great number of people is considered desirable.

While sunbathing, the sun's rays frequently causes the individual to profusely perspire and at this particular time, the individual becomes quite uncomfortable. In order to alleviate this uncomfortableness, it is known for the individual to wipe himself with a damp cloth, or apply a spray of water in the form of a mist with the spray being applied by the individual himself or herself through the use of a spray bottle.

Previously, it has been known to incorporate a water spray device in conjunction with a chair. Reference is to be had to U.S. Pat. Nos. 3,625,434/Kitover and 4,765,542/Carlson. The structures of these patents do provide for a water spray that is to be applied to the sunbathing individual and this water spray does alleviate the problem of the individual over heating. However, in both Kitover and Carlson, the adjustability of the nozzles to direct the flow of the water is minimal. Adjustability of the nozzles is important as individuals greatly vary in size and in shape.

SUMMARY OF THE INVENTION

The appartus of the present invention is designed to be utilized in conjunction with a conventional chair, such as a lounge chair, which is designed to be utilized by a human being within the outdoors environment. A water supply tank is utilized which includes a manually operated pressurization system which when activated causes water from the tank to be moved into a conduit arrangement. Within the conduit arrangement is a manually operated on/off valve which is to be utilized to permit flow through the conduit arrangement or to stop flow through the conduit arrangement. Also mounted within the conduit arrangement is a heat exchanger. The heat exchanger includes a coil. This coil includes a black exterior surface and when exposed to sunlight will cause heating of the water passing through the coil. Alternately, the coil could be subjected to ice to lower the temperature ofthe wate the water passing through the coil. The conduit assembly includes a series of spray nozzles with these spray nozzles being mounted at different locations of the frame of the chair. Each spray nozzle can be individually adjusted so as to direct the flow from the nozzle to the desired location. The purpose of the series of spray nozzles is to emit a water mist substantially even across the entire body of the human being occupying the chair. An umbrella may be attached to the chair whose function would be to shade the head portion of the individual occupying the chair. There may also be included in the umbrella a series of spray nozzles so that a mist could also be sprayed from the umbrella.

BRIEF DESCRIPTION OF THE DRAWING

FIG. 1 is a side elevational view of a lounge chair upon which has been mounted the water misting apparatus of the present invention;

FIG. 2 is a top plan view of the chair of FIG. 1 as well as the water misting apparatus of the present invention where a portion of the chair has been cut away so as to clearly show the heat exchanger;

FIG. 3 is a top plan view of one of the nozzles utilized in conjunction with the water misting apparatus of the present invention taken along line 3—3 of FIG.1 showing pivoting of the nozzle along a first axis;

FIG. 4 is a cross-sectional view taken along line 4—4 of FIG. 3 showing pivoting of the nozzle along a second axis;

FIG. 5 is a cross-sectional view through the heat exchanger utilized in conjunction with the water misting apparatus of this invention taken along line 5—5 of FIG. 1; and FIG. 6 is a cross-sectional view of the heat exchanger taken along line 6—6 of FIG. 5.

DETAILED DESCRIPTION OF THE SHOWN EMBODIMENT

Referring particularly to the drawing, there is shown a conventional lounge chair 10 which is designed to be folded into a collapsed state or can be unfolded into an extended state when the chair 10 is to be used by a human being. It is to be understood that the human being can lay in a substantially prone position on the webbing 11 which is securely fastened to a peripheral tubular frame 12. The chair 10 is located in a spaced position above ground 13 by means of legs 14 and 16. It is to be understood that the basic construction of the chair 10 is deemed to be conventional and actually any desired form of chair could be utilized whether it is a lounge chair or not.

Connected to the frame 12 is a water conducting conduit arrangement 18. The conduit arrangement 18 is to be fixedly positioned to the frame 12 by means of a series of ties 20. Included within the conduit arrangement 18 are a series of T-connectors 22. Each T-connector 22 connects with an extension tube 24. The outer end of the extension tube 24 has mounted thereon a nozzle 26. Water in mist form is designed to be emitted from the nozzles 26. It is to be noted that there are eight in number of the nozzles 26 mounted directly adjacent to the tubular frame 12.

Referring particularly to FIG. 3, it can be seen that the nozzles 26 are pivotable about the longitudinal center axis of the tubular extension 24. Also, in referring to FIG. 4, it can be seen that the nozzles 26, tubular extension 24 and T-connector 22 is capable of pivoting about an axis which coincides with the longitudinal center axis of the conduit 18. These axes are perpendicular to each other. This two-axis movement of the nozzle 26 permits manual movement in directing of the mist emitting from the nozzle 26 in a desirable direction. It is to be understood that once the desired position of the nozzle 26 has been obtained and it is released that the nozzle 26 will remain in that position.

Water is to be supplied through a main section of the conduit 30 to the conduit 18. Included within the main conduit 30 is a manually operated on/off valve arrangement 32. The main conduit 30 connects to a water supply tank 34. The water supply conduit 30 connects to the conduit 18 by means of a T-connector 28. The water supply tank 34 includes a manually operated pressurizing pump apparatus 36 which is deemed to be conventional. Up and down movement of the pressurizing apparatus 36 causes pressure to be produced within tank 34. When the valve 32 is moved to the open position, water is conducted through the conduit 30 to the conduit arrangement 18 which in turn results in water to be emitted in mist form through each of the nozzles 26. It is understood that the nozzles 26 are to be oriented so that the produced mist will be directed onto the upper surface of the webbing 11.

A portion of the conduit arrangement 18 is formed into a coil 38. Fixedly mounted on the exterior surface of the coil 38 is a black covering 54. This coil 38 is mounted within a chamber 42 of a container 40. Included within the container 40 is a door 44. The door 44 is capable of pivoting from the closed position shown in FIG. 6 to an open position (not shown) by means of a hinge 50. When in the closed position, the door 44 is latched shut by a latch 46. Connecting with the container 40 are a pair of hooks 48. These hooks 48 are to be utilized to mount the container 40 onto the tubular frame 12. It is to be understood that the conduit arrangement 18 is to be flexible enough so as to readily bend so as to accomodate the location of this heat exchanger which is defined generally as the container 40 and the coil 38.

The door 44 can be moved to an open position (not shown) which will expose the black covering 54 of the coils 38 to sunlight. The black coating 54 absorbs energy from the sun which is then conducted into the water contained within the coil 38. As a result, this water is to be heated prior to being dispensed in mist form through the nozzles 26.

If the user desires not to have the water heated, the user may decide to have the water cooled. In such a situation, ice 52 could be placed within the chamber 42 and the door 44 closed. The ice 52 would function to cool the water passing through the coil 38. On a very hot day, the human being user may utilize the ice 52. Possibly on a cooler day, the user would not utilize ice and instead would open the door 44 in order to heat the water within the coil 38.

If the human being user desires, there may be utilized as a separate attachment an umbrella. The umbrella includes a series of fabric panels which are mounted on a frame defining a dome 60. Centrally mounted to the dome 60 is a shaft 56. The outer end of the shaft 56 is mounted to a clamping device 58 which is to be manually operated to mount onto the frame 12 in a desired location. A water conduit arrangement 64 is mounted in conjunction with the umbrella with this conduit 64 to be connected by a connector 62 to the conduit arrangement 18. Mounted in conjunction with the conduit arrangement 64 are a plurality of nozzles 66 which are similar to nozzles 26 and are to be similarly adjustable.

The operation of the water misting apparatus of this invention is as follows: Prior to the human being occupying the chair 10, the human being activates the pressurizing apparatus 36 which pressurizes the supply of water contained within the water supply container 34. The human being user then occupies the chair 10 and releases spurts of water in mist form from the nozzles 26 (and nozzles 66 if the umbrella is utilized) by manual opening of the valve 32. It is to be understood that when the umbrella is not utilized that the connector 62 will be located in a shut-off position preventing flow of water through connector 62.

What is claimed is:

1. In combination with a chair, a water misting apparatus for dispensing of a water mist onto a human being occupying said chair, said water misting apparatus comprising:

a plurality of water misting dispensing nozzles mounted on said chair at selected spaced apart locations, each said nozzle being manually adjustable relative to said chair to change the direction of flow of water from each said nozzle;

conduit means connecting said nozzles, said conduit means supplying water to said nozzles, said conduit means being mounted on said chair;

a water supply tank located directly adjacent said chair but spaced therefrom, said conduit means being connected to said water supply tank, said water supply tank including pressure means for causing water contained within said tank to flow through said conduit means to said nozzles, a manually operated flow control valve mounted in conjunction with said conduit means, said manually operated flow control valve being located between said tank and said nozzles;

a heat exchanger mounted in conjunction with said conduit means, said heat exchanger facilitating the transmission of heat between said conduit means and an exterior source; and said exterior source comprising ice.

2. In combination with a chair, a water misting apparatus for dispensing of a water mist onto a human being occupying said chair, said water misting apparatus comprising:

a plurality of water misting dispensing nozzles mounted on said chair at selected spaced apart locations, each said nozzle being manually adjustable relative to said chair to change the direction of flow of water from each said nozzle;

conduit means connecting said nozzles, said conduit means supplying water to said nozzles, said conduit means being mounted on said chair;

a water supply tank located directly adjacent said chair but spaced therefrom, said conduit means being connected to said water supply tank, said water supply tank including pressure means for causing water contained within said tank to flow through said conduit means to said nozzles, a manually operated flow control valve mounted in conjunction with said conduit means, said manually operated flow control valve being located between said tank and said nozzles; and a heat exchanger mounted in conjunction with said conduit means, said heat exchanger facilitating the transmission of heat between said conduit means and an exterior source, said heat exchanger having an internal chamber, said conduit means forming a coil within said internal chamber, said heat exchanger having a door, said door being movable between an open position and a closed position, said open position exposing said coil to the ambient thereby exposing said coil to the rays of the sun which constitutes said exterior source.

3. The combination as defined in claim 2 wherein:

said manual adjustment of each said nozzle being achieved by each said nozzle being pivotable relative to said conduit means.

4. The combination as defined in claim 3 wherein:

said pivoting of each said nozzle being achievable by having each said nozzle pivotable along two separate pivot axes.

5. The combination as defined in claim 4 wherein:

said two separate pivot axes being perpendicular to each other.

6. The combination as defined in claim 2 wherein:

an umbrella being connectable to said chair, a portion of said water misting apparatus being connected to said umbrella.

* * * * *